United States Patent [19]

Roller

[11] Patent Number: 4,984,501

[45] Date of Patent: Jan. 15, 1991

[54] APPARATUS FOR PROCESSING CARTRIDGE CASES

[76] Inventor: Johannes Roller, Siebensterngasse 43, A-1070 Vienna, Austria

[21] Appl. No.: 527,712

[22] Filed: May 22, 1990

Related U.S. Application Data

[63] Continuation of Ser. No. 385,675, Jul. 26, 1989, abandoned.

[30] Foreign Application Priority Data

Aug. 8, 1988 [AT] Austria ..... 1998/88

[51] Int. Cl.[5] ..... F42B 33/10; F42B 33/02; B21D 51/54; B21K 21/04

[52] U.S. Cl. ..... 86/36; 29/132; 86/23; 86/24

[58] Field of Search ..... 86/23, 24, 36, 24, 37, 86/43; 29/1.3 Q, 1.3, 1.31; 73/167; 42/90; 102/430, 469, 470

[56] References Cited

U.S. PATENT DOCUMENTS

| | | | |
|---|---|---|---|
| 3,134,293 | 5/1964 | Lee | 86/24 |
| 4,273,024 | 6/1981 | Veloni | 86/1.1 |
| 4,385,546 | 5/1983 | Lee | 86/36 |
| 4,537,112 | 8/1985 | Dabonde | 86/37 |
| 4,675,958 | 6/1987 | Rosenbaum et al. | 29/1.32 |
| 4,723,472 | 2/1988 | Lee | 86/24 |
| 4,807,511 | 2/1989 | Markle | 86/24 |
| 4,836,078 | 6/1989 | Lee | 86/24 |

*Primary Examiner*—Howard J. Locker
*Attorney, Agent, or Firm*—Kurt Kelman

[57] ABSTRACT

An apparatus for processing cartridge cases, particularly for distinguishing between different fuzing systems of cartridge cases for center fire cartridges, comprises sensing means, which are reciprocable along the longitudinal center line of the cartridge case from and to a predetermined initial position, and means which oppose a displacement of the sensing means from the initial position. Means may be provided for indicating a displacement of the sensing means from their initial position. The apparatus may constitute a cartridge case processing tool for use in a machine for loading cartridge cases for center fire cartridges or may be integrated in the sizing die of such machine. The sensing means may comprise mechanical sensing means or an optical sensor, which is adapted to be inserted into the cartridge case and is opertively connected to an indicator.

43 Claims, 2 Drawing Sheets

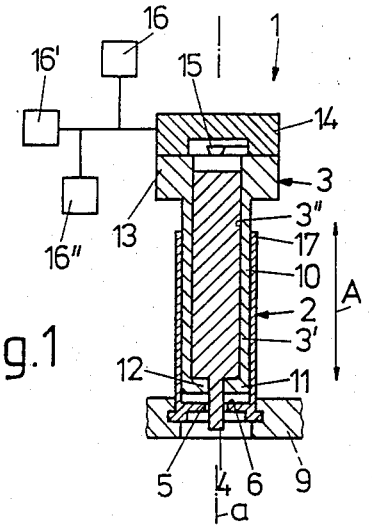
Fig.1
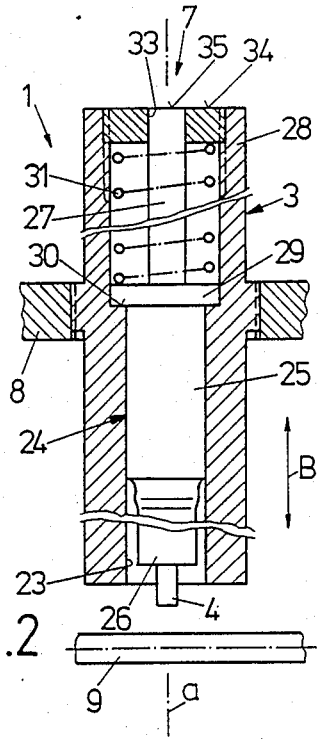
Fig.2
Fig.3
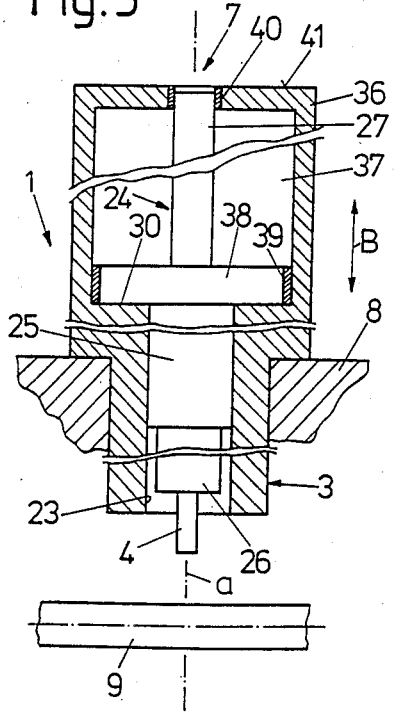
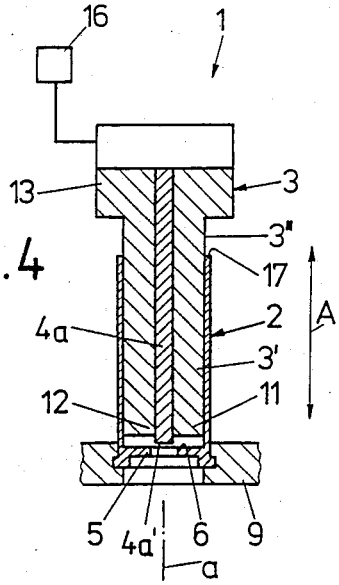
Fig.4

APPARATUS FOR PROCESSING CARTRIDGE CASES

CROSS-REFERENCE TO RELATED APPLICATION

This is a continuation of my copending U.S. patent application Ser. No. 385,675, filed in July 26, 1989 now abandoned.

BACKGROUND OF THE INVENTION (1) Technical Field

This invention generally relates to the processing of cartridge cases for center fire cartridges. More specifically the invention relates to the inspection of cartridge cases e.g., of their fuzing system or their dimensional accuracy, or as to whether or not the primer caps have been removed from the cartridge cases.

An important problem arising in connection with the loading or reloading of cartridge cases (ammunition reloading) of modern center fire cartridges is the need for distinguishing between different cartridge cases which are identical with the exception of their fuzing systems. Ammunition loading or reloading equipment or ammunition loading or reloading machines in which new cartridge cases or cartridge cases which have been fired once or several times are filled with gunpowder or another propellant, provided with a primer cap, and in some machines are provided with a projectile, are designed for a processing and handling of cartridge cases having a uniform fuzing system.

(2) Description of the Prior Art

The so-called boxer fuzing system for center fire cartridges comprises a primer cap having a built-in anvil. The anvil is a conical member, which has been pressed into the primer cap and which when the cartridge is being fired presents a resistance to the impinging firing pin or hammer of the firearm and thus promotes the ignition of the priming explosive, which is disposed between the top of the anvil, under the striking action of the firing pin or hammer.

The cartridge cases for receiving boxer primer caps have a vent at the center of the primer pocket, which is provided in the cartridge case and contains the primer cap. The fired primer cap is removed from such a cartridge case by means of a pin, which is inserted into the cartridge case from above, i.e., from the mouth of the case, and forced against the primer cap so that the latter is forced out of the primer pocket.

On the other hand, cartridge cases provided with the so-called Berdan fuzing system have an anvil which is fixedly installed in the primer pocket or is integral with the case. For this reason Berdan primer caps have no anvil and their vent is eccentriclly formed in the primer pocket because that parat of the case which constitutes the anvil is exactly centered. In order to ensure a uniform performance of the fuzing opration in Berdan cases, they are often formed with two or three vents, all of which are eccentrically disposed in the case or primer pocket so that the case would severly be damaged by an attempt to remove the primer cap by an ejecting operation along a straight line, as has been described for the boxer system. Because the primer caps used in the two fuzing systems differ in size, it is not possible to use boxer primer caps in Berdan cartridge cases and Berdan primer caps in boxer cartridge cases.

The processor of case material faces the problem that cartridge cases which have the same appearance but contain mutually incompatible fuzing systems must be distinguished and sorted quickly and at proper times. That problem will become particularly critical in connection with the reloading of previously fired cartridge cases. In that case an inadvertent processing of Berdan cases on machines specifically designed for a reloading of boxer cases must be prevented and it must be ensured that a case provided with a boxer fuzing sytem will not inadvertently be processed on a Berdan machine. The pressing of a primer cap into a cartridge case which is not proper for that primer cap may result in an unintended ignition of the primer cap and this may have numerous consequences, all of which are most undesirable.

The faster and the more automatic a machine for reloading fired cartridges is operated, the more disastrous will be the consequences of a confusion of boxer and Berdan cases on the mechanism of the machine.

In the United States, where the reloading of fired cartridge cases is performed on a large scale, the cartridge cases predominantly consist of boxer cases. For this reason the manufacturers of the machines for processing cartridge cases, whether said machines are manually operated or motor-driven, have not incorporated means for a protection against such confusion in the machines thus far.

SUMMARY OF THE INVENTION

It is an object of the invention to provide an apparatus which can be used for a satisfactory testing and inspecting of cartridge cases even if they have different fuzing systems.

It is another object of the invention to provide for the processing of cartridge cases an apparatus which can be used to reliably and safey distinguish cartridge cases provided with different fuzing systems and which is integrated or is adapted to be integrated in a manually operated or motor-driven machine for loading cartridge cases.

It is a further object of the invention to provide an apparatus which can be used for a satisfactory and safe distinction of cartridge cases provided with different fuzing systems and which can detect also the absence or presence of a primer cap and which is integrated or is adapted to the integrated in a tool of such machine.

The invention provides a cartridge case detector, which comprises sensing means, which are reciprocable along the longitudinal center line of the cartridge case from and to a predetermined initial position and which cooperate with means which oppose a displacement of the sensing means from the initial position. Means may be provided for indicating a displacement of the sensing means from the initial position.

The sensing means may be accommodated in a housing, which is reciprocable along the longitudinal center line between a stand-by position and an operative position.

The cartridge case detector provided in accordance with the invention can be used for a definite distinction between boxer cases and Berdan cases. In dependence on the type of cases to be processed in a cartridge case loading machine the apparatus in accordance with the invention can be used to reject the other (incompatible) cases. Besides, the apparatus in accordance with the invention can be used to safely distinguish between boxer cases having no inserted primer cap, boxer cases having an inserted primer cap, and Berdan cases. Any means for indicating the displacement of the sensing means will suitably provide different indications for the cases of said three types.

In accordance with a further feature of the invention the cartridge case detector is integrated in a cartridge case processing tool of a cratridge case loading apparatus, which has a machine body, which is reciprocable between a stand-by position and an operative position relative to a cartridge case conveyor along the center line of the cartridge cases which are held by said conveyor. The displacement of the sensing means is independent of the movement of the machine body of the cartridge case loading apparatus. In that embodiment the apparatus in accordance with the invention may be arranged in the cycle of operations of the cartridge case loading apparatus for a detection of imcompatible cartridge cases.

In acordance with a further feature of the invention the cartridge case detector may be integrated in the cartridge case sizing die of a cartridge case loading apparatus. In that case the apparatus in accordance with the invention may be integrated as an imcompatibility detector for detecting imcompatible cases into the case-sizing station of the loading machine so that in an existing loading machine it will be sufficient to replace the sizing die by a tool comprising an imcompatibility detector in accordance with the invention and a different working station for a detection of incompatible cases will not be required.

In the design of a new cartridge case loading machine, a separate working station for the cartridge case detector may be provided. For that purpose a further embodiment of the invention is constituted by a cartridge case processing tool for use in such machine for loading cartridge cases for center fire cartridges. That machine compirses a conveyor for the cartridge cases and a machine body, which serves to receive tools and is movable relative to the conveyor along the longitudinal center line of the cartridge cases. That machine body is reciprocable along said longitudinal center line between positions corresponding to a stand-by position and an operative position of the tools.

The tool in accordance with the invention comprises a housing, which is adapted to be secured to the machine body and in which the sensing means, which are reciprocable from and to a predetermined initial position, and the means which oppose the displacement of the sensor means, are accommodated. The tool in accordance with the invention may also comprise means which are operatively connected to the sensing means and serve to indicate the displacement of the sensing means from the initial position.

In order to reduce the number of working stations of that cartridge case loading machine, the housing of that embodiment of the invention may be formed with a cylindrical internal bore, which is centered on the longitudnal axis of the cartridge cases and contains means for sizing the cartridge cases at their outside peripheral surface. In that case the imcompatibility detector and the case-sizing die will be combined in a tool provided in one working station.

In accordance with a further feature of the invention the sensing means constitute an ejector for a primer cap which is disposed in a central vent of a fired cartridge case. The strongest force which is exerted by the means which oppose a displacement of the sensing means exceeds the force tht is required to eject the primer cap. That design is particularly desirable for cartridge case loading machines which are designed to process boxer cases. In such loading machines the boxer cases are sized in a working station, in which they are forced into a sizing die so that the diameter of the case will equal to the standard diameter or caliiber. The sizing die is provided with a rod, which is rigidly connected to the die and which is connected at its lower end to an ejector pin, which is moved through the central vent of the cartridge case during the sizing operation and thus ejects the fired old primer cap out of the case. In such a boxer case loading machine the sizing die or the associated rod, which carries the ejector pin and has been screwed into the die body, may be replaced by the detector in accordance with the invention or by the tool in accordance with the invention, so that the advantage will be afforded that Berdan cases will reliably be detected during the sizing operation and additional advantages will be afforded in connection with the ejection of fired primer caps from fired boxer cases. Because the resistance opposing the ejection of a primer cap from the vent of a boxer case is much smaller than the resistance opposing the piercing of the solid base of a Berdan case, the apparatus in accordance with the invention will remove the primer caps from boxer cases whereas Berdan cases will not be damaged and will be indicated.

In accordance with a further feature of the invention the sensing means may be biased to their end position. Owing to the biasing of the sensing means which constitute an ejector, the slidable insertion of the sensing means into boxer cases containing fired primer caps will result in a gradual build-up of pressure and that a sudden pressure relief will occur when the resistance to the ejection of the primer cap has been overcome and will result in such an acceleration of the primer cap being ejected that a seizing of the inside surface of the primer cap on the ejector pin and a subsequent retraction of the primer cap into the cartridge case as it is pulled from the ejector pin will be prevented. Such a seizing and retraction of the primer cap to be ejected tend to occur in known high-speed boxer case loading machines.

To ensure that fired primer caps will be ejected even from corroded boxer cases, the bias of the sensing means or of the ejector is selected to overcome the resistance of the means which oppose the ejection of the primer cap in such corroded cases, in which said resistance is higher than in uncorroded boxer cases. To that end the spring bias of the ejector is so selected that the pressure which has gradually been built up until the selected bias has been reached will be insufficient for a piercing of the base of the primer cap so that an ejection of the entire primer cap even from corroded boxer cases will be ensured.

In accordance with a further embodiment of the invention the sensing means may consist of mechanical feelers or of an optical sensor, which is introduced into the cartridge case and is operatively connected to a visual indicator.

BRIEF DESCRIPTION OF THE DRAWING

The above and further objects, advantages and features of the present invention will become more clearly apparent from the following detailed description of some illustrative embodiments of the invention which are diagrammatically shown in the drawings, in which FIG. 1 is longitudinal sectional view showing a first embodiment of the detector in accordance with the invention for use in conjunction with a cartridge case that has a central vent and is held on a conveyor of a cartridge case loading machine.

FIG. 2 is a longitudinal sectional view showing a second embodiment, which is integrated in a sizing tool of a cartridge case loading machine and comprises an integrated primer cap.

FIG. 3 is like FIG. 2 a longitudinal sectional view and shows a pneumatic detector for detecting incompatible cartridge cases in a cartridge case loading machine.

FIG. 4 shows a further embodiment of the detector comprising a sensor which consists of an optical glass fiber cable.

DETAILED DESCRIPTION OF PREFERRED EMBODIMENTS

Figure 5:
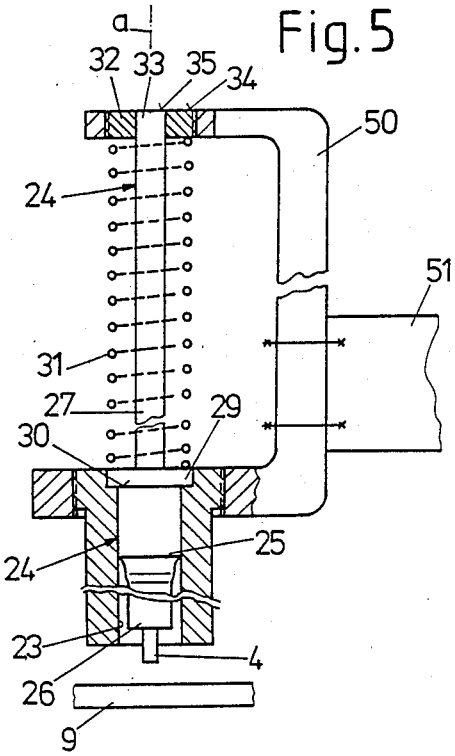
FIG. 5 is a longitudinal sectional view showing a further embodiment of the detector having a C-shaped frame.

In the drawings, like parts of the various embodiments of the invention shown in different figures are designated by the same reference numerals. The apparatus in accordance with the invention is adapted to be installed or integrated in a cartridge case loading apparatus, which in itself does not constitute a part of the present invention and for this reason is not described or shown more in detail. On the other hand the invention does relate to a cartridge case processing tool which is incorporated in such a cartridge case loading apparatus and provided with a cartridge case detector in accordance with the invention.

The device in accordance with the invention for distinguishing between the fuzing systems of cartridge cases for center fire cartridges, e.g., between boxer and Berdan cartridge cases, will be described hereinafter as an incompatibility detector or briefly as a detector. When the device in accordance with the invention is used as a detector for detecting Berdan cases in a boxer cartridge case loading machine the boxer cases will be the "compatible" cartridge cases and the Berdan cases will be the "incompatible" cartridge cases. If the device in accordance with the invention is used to detect boxer cases in a Berdan cartridge case loading machine, the Berdan cases will be the "compatible" cartridge cases and the boxer cases will be the "incompatible" cartridge cases.

FIG. 1 shows a detector 1 in an operative position. The detector 1 essentially consists of a pin 4, which is slidably mounted in a housing 3 and is adapted to be slidably inserted into a cartridge case 2 along the center line (a) of said case and to enter the central vent 5 formed in the base 6 of the cartridge case 2. The detector also comprises an indicatior 16 for indicating the displacement of the pin 4 from its end position. The housing 3 is mounted to be displaceable between a stand-by position and an operative position along the axis (a) of the cartridge case in the direction indicated by the Arrow A.

If the housing 3 is secured to a machine body 8 of a cartridge case loading apparatus, as is shown in FIGS. 2 and 3, the housing 3 will be moved to its stand-by and operative positions in that a relative movement along the (a) of the cartridge case (arrows A, B) is imparted to the machine body 8, on the one hand, and a conveyor 9, on the other hand, on which the cartridge cases 2 are held and which is only diagrammatically indicated in FIGS. 2 and 3.

The imcompatibility detector 1 shown in FIG. 1 comprises an axially displaceable sensing pin 4, which is biased by gravity. The housing 3 of the detector 1 comprises a cylindrical extension 3' that has a cylindrical outside surface, which has an outside diameter matching the inside diameter of the cartridge cases 2. A bore 3'' is formed in the housing 3 and in its extension 3' and contains a cylindrical weight 10, which at its bottom end carries the sensing pin 4. The sensing pin 4 protrudes out of the bottom end 11 of the cylindrical extension or section 3' of the housing 3 through an opening 12. A microswitch 14 is secured to the topo end 13 of the housing 3 and comprises a spring-biased actuating arm 15 that is disposed above the weight 10. The microswitch 14 is electrically connected to a merely digrammatically illustrated indicator 16 or to a merely diagrammatically indicated alarm signal generator 16' and/or to switching means 16".

That detector operates as follows:

The incompatibility detector shown in FIG. 1 is moved from its stand-by position, in which the detector is spaced from the cartridge case 2, to an operative position, which is shown in FIG. 1. To that end the housing 3 of the detector is slidably inserted from above into the cartridge case 2, which in a cartridge case loading machine, not shown, is held on a conveyor 9, not shown in detail, in a substantially vertical orientation with the mouth 17 of the case disposed at its top end. In the cartridge case 2 the housing is displaced as far as to the base 6 of the case 2. If the incompatibility detector 1 is thus slidably inserted into a boxer case 2, the sensing pin 4, which is urged biy the weight 10 to a predetermined lower end position, will enter the central vent 5 in the base 6 of the case but this will not result in a displacement of the sensing pin in the housing 3 and in an actuation of the microswitch 14. If the detector 1 is displaced as far as to its operative position in a cartridge case 2 which has no central vent or in a cartridge case in which a primer cap is contained in a central vent, the sensing pin 4 engaging the closed base of the case or the primer cap will be pushed back into the housing 3 and against the actuating arm 15 of the microswitch 14 to actuate the latter so that the indicator 16 will indicate an incompatible case rather than a boxer case, which will be indicated if the microswitch 14 is not acutated. The microswitch 14 may be electrically connected to an alarm signal generator 16', which will generate an alarm signal in response to the actuation of the microswitch 14. The microswitch 14 may optionally be electrically connected to switching means 16", which in case of detection of an incompatible case by the microswitch 14 will shut down the cartridge case loading machine.

The detector 1 will reliably distinguish between cartridge cases 2 having an open central vent 5 and other (incompatible) cartridge cases. The detector 1 may be used in a cartridge case loading machine for boxer cases and in that case will permit a rejection of Berdan cases, which are indicated in response to the actuation of the microswitch, or the detector 1 may be used to reject boxer cases in a machine for loading Berdan cases. In a machine for loading boxer cases, the detector 1 will indicate whether or not a primer cap is still contained in the central vent.

In the embodiment of the detector shown in FIG. 2 the housing 3 in intergrated in a sizing tool, which has been screwed into the machine body 8 of a cartridge case loading machine and which has an internal bore 23 matching the standard caliber of the cartridge case 2 or is provided in known manner with a corresponding annular sizing die, not shown. Fired cartridge cases 2 are forced by the cartridge case loading machine into said bore or die in order to size the cases. A cylindrical rod 24 is axially slidably disposed in that internal bore 23, which has bottom end portion tht constitutes the sizing die. That cylindrical rod 24 comprises three sections, namely, (a) a constraining section 25, which is guided in the internal bore 23, (b) a bottom section 26, which carries the pin 4 and is adapted to be inserted into a cartridge case which is disposed in the sizing die, and (c) a top section 27, which protrudes into a spring housing 28, which is formed in the housing 3. Between the constraining section 25 and the top section 27 of the rod 24, the latter is provided with a collar 29, which protrudes from the constraining section 25 and rests on the bottom wall 30 of the spring housing 28 and constitutes a spring abutment for engaging the rod-side end of a compression spring 31, which is disposed in or received by the spring housing 28. That spring 31 bears at its other end on a spring abutment which has been screwed into the spring housing 28. That spring abutment 32 has a central through bore 33, through which the top end of the rod 24 extends. The top end face 34 of the spring abutment 32 and the top end face 35 of the rod 24 together constitute the indicator 7 of the incompatibility detector 1. Said two end faces 34, 35 will be coplanar when the sensing pin 4 biased by the compression spring 31 is in its initial position and the top end of the rod will be distinctly protrude above the spring abutment 32 when the sensing pin has been displaced from its initial position e.g., because it has engaged the base of a Berdan case.

In tht embodiment of the detector 1 the rod 24, which is biased by the compression spring 31, and the pin 4, which is integrally formed with the rod 24, constitute a biased ejector for ejecting fired primer caps from boxer cases. The force which is exerted by the compression spring 31 on the rod and the ejector pin 4 exceeds the force that is required to eject the primer cap from the primer pocket of the cartridge case 2. Owing to the provision of that incompatibility detector the following operations performed by the cartridge case loading machine: sizing the fired boxer sleeves and ejecting the fired primer caps from the primer pocket of the boxer case 2, are integrated in one working station with the detection of any Berdan cases.

The illustrative embodiment shown in FIG. 3 is similar to the embodiment shown in FIG. 2, with the difference that the compression spring which biases the pin has been replaced by a piston, which is biased by compressed air to urge the pin to its initial position. For that purpose the housing 36 contains a compressed air chamber 37, into which the top section 27 of the rod protrudes, and the collar between the top section 27 and the constraining section 25 is constituted by a piston 38, which is sealed by a seal 39 against the cylindrical inside surface of the compressed air champer 37. The top end portion of the rod 24 is guided in a bore 40, which is provided with a seal, and together with the top end wall 41 of the housing 36 constitutes an indicator 7.

The compressed air chamber 37 may be connected to a compressed air source by a compressed air port, not shown. The pressure in the compressed air chamber 37 may be adjusted by a valve incorporated in the compressed air supply line. Alternatively, the housing 36 may be provided with a compressed air tubular port, which contains a non-return valve and through which the compressed air chamber 37 is supplied with compressed air to provide the desired pressure only once whereas only any leakage losses must then be compensated by an additional supply of compressed air.

The detector 1 shown in FIG. 4 is similar to that shown in FIG. 1 with the difference that the vent 5 of the cartridge case 2 is not mechanically detected by a pin but is optically detected by means of an optical glass fiber cable 4*a*. The free end 4*a* of the optical cable 4*a* is introduced close to the base 6 of the case. The optical cable 40 extends into the indicator 16 and indicates there the difference between the optical effects of an empty vent 5 and of a solid case base 6.

FIG. 5 shows a modification of the detector of FIG. 2. The rod 24 which carries the pin is guided in a C-shaped body 50 and the compression spring 31 which biases the rod 24 is exposed. The body 50 may be screwed into a machine body 51.

Figure 6:
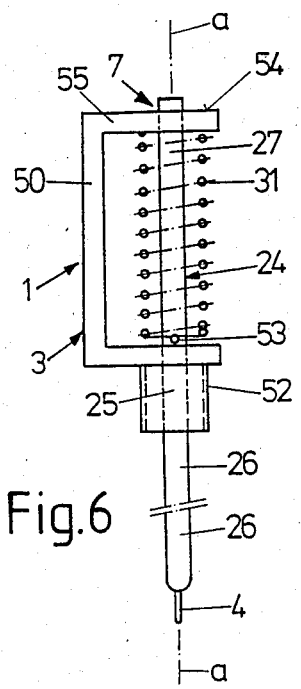
FIG. 6 is a longitudinal sectional view showing a still further embodiment of a detector having a C-shaped frame.

FIG. 6 shows also a detector 1, which comprises a C-shaped body 50, in which the rod 24 is guided, which carries the pin 4. The C-shaped body 50 comprises a cylindrical extenstion 52, which is formed with external screw threads for connecting the body 50 to a machine body (not shown) or to a conventional cartridge case sizing die. At the transition from its constraining section 25 to its top section 27 the rod 24 has a transverse bore, which receives a pin 53, which constitutes an abutment for the spring 31. In that embodiment there are no means for adjusting the spring 31 and the indicator 7 is constituted by the top face 54 of the upper transverse leg 55 of the C-shaped frame 50 and by the top end face of the rod 24.

Figure 7:
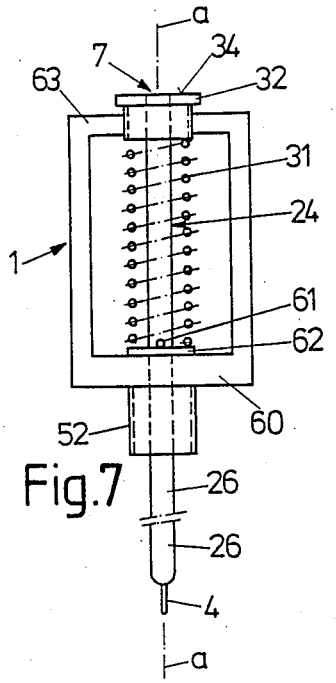
FIG. 7 is a longitudinal sectional view showing an embodiment of a detector having an O-shaped frame.

FIG. 7 shows a detector 1 which differs from the one shown in FIG. 6 mainly in that it has a frame 60 which is closed in O-shape and constitutes a laterally open housing for the spring 31. The spring 31 bears at its bottom end on two pins 61, 62, which are at right angles to each other and which extend into two transverse bores, which are formed in the rod 24 and extend at right angles to each other. The top end of the spring 31 bears on a spring abutment 32, which has been screwed into the upper crosspiece 63 of the frame 60 and which has a top end face 34 that constitutes a portion of the indicator 7.

Figure 8:
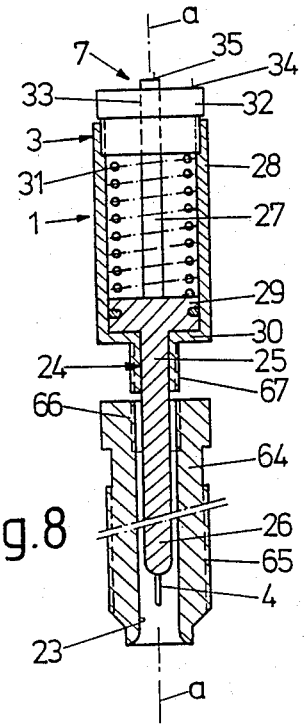
FIG. 8 is a longitudinal sectional view showing a detector in an embodiment which is adapted to be screwed into a conventional sizing die.

The detector 1 shown in FIG. 8 is similar to the detector shown in FIG. 2 and is screwed into the top of a conventional sizing die 64, which has external screw threads 65 for fixing the die 64 in a machine body, not shown. The conventional sizing die 64 is provided near the top end of its internal bore 23 with internal screw threads 66, which are normally screwed onto a stationary ejector rod. That ejector rod has now been replaced by a detector 1 in accordance with the invention. The housing 3 of that detector is provided with a cylindrical extension 67, which has external screw threads to be screwed into the internal screw threads 66 of the bore 23 of the sizing die 64.

It will be understood that the illustrated embodiments of the apparatus in accordance with the invention may be modified by those skilled in the art within the scope of the appended claims. For instance, the piston which is biased by compressed air may be replaced by a diaphragm that is fixedly connected to the pin 4 or to the rod 24 which carries the pin 4. Instead of a compression spring consisting of a cylindrical coil spring 31, a disk spring may be used or two concentric coiled compression springs may be used and such compression springs may be designed to bias the pin 4, or the rod 24 which biases the pin 4, to its initial position, or may be so arranged and designed that the compression springs will be relaxed when the pin is in its initial position so that no spring force will then be exerted on the pin 4 or on the rod 24 when it is in its initial position. The pin may have a certain backlash in its initial position because the compression springs are arranged to be strained only when the pin 4 has been displaced from its initial position to some extent. This may be desirable if a primer cap disposed in a boxer case is to be indicated before it is ejected rather than during its ejection.

The pin 4 may be integral with the rod 24 or may have been screwed into the rod 24 or be connected to the joint 24 by different means.

It will be understood that the cartridge case may be axially fixed while the pin is slidably inserted from above into the cartridge case along the axis of the latter. Alternatively, the cartridge case may be axially displaced from below to axially fit over the pin. To that end it is possible in a cartridge case loading apparatus either to reciprocate the housing that carries a pin between an operative position and a stand-by position relative to a cartridge case conveyor which is at a standstill or the cartridge case conveyor may reciprocate the cartridge cases relative to the housing carrying the pin may be stationary and the cartridge case conveyor may reciprocate the cartridge cases between the operative position and the stand-by position relative to said stationary housing. The terms "stand-by position" and "operative position" of the housing which carries the pin are applicable to certain positions of the housing relative to the cartridge case which is to be processed, regardless of whether the housing is stationary, e.g., because it is secured to a stationary machine frame, or may be reciprocated, e.g., by a reciprocated machine frame, to which the housing is secured.

I claim:

1. A detector device for distinguishing between two different fuzing systems of cartridge cases for center fire cartridges, each cartridge case comprising a base at one end, defining an open mouth at an opposite end, and having an inside peripheral surface, an outside peripheral surface and a longitudinal center line, the fuzing system of each cartridge case being held in the base and one of the fuzing systems including a central vent coaxial with the center line in the base, which comprises (a) a housing, (b) a movable sensing means for sensing the central vent in the cartridge case base, (1) the sensing means being movably arranged in the housing for movement along the longitudinal center line, (2) the sensing means being movable into the cartridge case through the cartridge case mouth and along the longitudinal center line by movement of the housing relative to the cartridge case until the sensing means senses an open central vent in the cartridge case base, and (3) the sensing means being arranged during the relative movement in a predetermined initial position which enables the sensing means to be displaced relative to the housing in a direction opposite to the direction of movement into the cartridge case in the absence of an open vent in the cartridge case base, (c) a repositioning means arranged to (1) hold the sensing means in the predetermined position during the movement into the cartridge case, (2) oppose the displacement of the sensing means from the predetermined position, and (3) return the sensing means to the predetermined initial position after it has been displaced, and (d) an indicator means arranged to indicate the displacement of the sensing means as indicating the fuzing system held in the cartridge case base.

2. A detector according to claim 1 for inspecting cartridge cases containing the one fuzing system including a fired primer cap closing the central vent, wherein the movable sensing means is an ejector arranged to eject the primer cap from the central vent and the repositioning means is adapted to exert on the ejector a force exceeding the force required to eject the primer cap.

3. A detector according to claim 1, wherein said sensing means comprise an axially displaceable pin.

4. A detector according to claim 1, wherein the housing comprises a cylindrical extension, which is centered on the longitudinal center line of the cartridge case and is adapted to be inserted into the interior of the cartridge case and has an outside peripheral surface matching the inside peripheral surface of the cartridge case.

5. A detector according to claim 1, wherein the housing is formed with a cylindrical internal bore, which is centered on the longitudinal center line of the cartridge case and is adapted to receive the cartridge case and has an inside peripheral surface matching the outside peripheral surface of the cartridge case.

6. A detector according to claim 5, further comprising means for sizing the cartridge case at its outside peripheral surface in said internal bore.

7. A detector according to claim 3, wherein the means opposing the displacement of the pin from the predetermined initial position comprise a weight that acts only by gravity.

8. A detector according to claim 3, wherein the means opposing the displacement of the pin from the predetermined initial position comprise a spring.

9. A detector according to claim 8, wherein the pin is biased to its end position by the spring.

10. A detector according to claim 9, wherein the spring has an adjustable initial stress.

11. A detector according to claim 3, wherein the means opposing the displacement of the pin from the predetermined initial position comprise a piston which is biased by compressed air.

12. A detector according to claim 11, wherein the pin is biased to its initial position.

13. A detector according to claim 1, wherein the housing has a cylindrical internal bore, which is centered on the longitudinal center line of the cartridge case, the sensing means comprise a rod, which is axially slidably mounted in said internal bore and at one end is provided with a pin, which carries a spring abutment, and a compression spring is disposed in the housing and at one end bears on said spring abutment and at the other end bears on the housing.

14. A detector according to claim 1, wherein a compressed air chamber is contained in the housing and a piston that is biased by compressed air is slidably mounted in said compressed air chamber and is secured to a rod, which is axially slidably mounted in the housing and at one end carries the sensing means consisting of a pin.

15. A detector according to claim 1, wherein the predetermined initial position is adjustable.

16. A detector according to claim 1, wherein the indicating means comprises a visual indicator.

17. A detector according to claim 3, further comprising a rod which carries the pin disposed in the housing, said housing having an end wall which is formed with a hole and that end of the rod which is remote from the pin protruding into said hole and together with said end wall constituting a visual indicator.

18. A detector according to claim 1, wherein the indicating means comprises an electric switch, which is arranged to be actuated in response to a predetermined displacement of the sensing means.

19. A detector according to claim 18, wherein the indicating means is electrically connected to an alarm signal generator.

20. A detector according to claim 18, wherein the indicating means is electrically connected to switching means.

21. In a loading or reloading or processing apparatus for center fire cartridges, a tool for processing cartridge cases with different fuzing systems, each cartridge case comprising a base at one end, defining an open mouth at an opposite end, and having an inside peripheral surface, an outside peripheral surface and a longitudinal center line, the fuzing system being held in the base and one of the fuzing systems including a central vent coaxial with the center line in the base, which comprises (a) a housing, (b) a movable sensing means for sensing the central vent in the cartridge case base, (1) the sensing means being movably arranged in the housing for movement along the longitudinal center line, (2) the sensing means being movable into the cartridge case through the cartridge case mouth and along the longitudinal center line by movement of the housing relative to the cartridge case until the sensing means senses an open central vent in the cartridge case base, and (3) the sensing means being arranged during the relative movement in a predetermined initial position which enables the sensing means to be displaced relative to the housing in a direction opposite to the direction of movement into the cartridge case in the absence of an open vent in the cartridge case base, (c) a repositioning means arranged to (1) hold the sensing means in the predetermined position during the movement into the cartridge case, (2) oppose the displacement of the sensing means from the predetermined position, and (3) return the sensing means to the predetermined initial position after it has been displaced, and (d) an indicator means arranged to indicate the displacement of the sensing means as indicating the fuzing system held in the cartridge case base.

22. A tool according to claim 21, wherein the apparatus comprises a conveyor for conveying the cartridge cases and a machine body for receiving at least one of said tools, the tool housing being insertable in the machine body, and the conveyor and machine body being movable relative to each other and parallel to the longitudinal center line for moving the sensing means into the cartridge case.

23. A tool according to claim 21, wherein said sensing means comprise an axially displaceable pin.

24. A tool according to claim 23 for processing cartridge cases containing the one fuzing system including a fired primer cap closing the central vent, wherein the movable sensing means is an ejector arranged to eject the primer cap from the central vent and the repositioning means is adapted to exert on the ejector a force exceeding the force required to eject the primer cap.

25. A tool according to claim 21, wherein the housing comprises a cylindrical extension, which is centered on the longitudinal center line of the cartridge case and is adapted to be inserted into the interior of the cartridge case and has an outside peripheral surface matching the inside peripheral surface of the cartridge case.

26. A tool according to claim 21, wherein the housing is formed with a cylindrical internal bore, which is centered on the longitudinal center line of the cartridge case and is adapted to receive the cartridge case and has an inside peripheral surface matching the outside peripheral surface of the cartridge case.

27. A tool according to claim 26, further comprising means for sizing the cartridge case at its outside peripheral surface in said internal bore.

28. A tool according to claim 23, wherein the means which oppose a displacement of the pin from its initial position comprise a weight that acts only by gravity.

29. A tool according to claim 23, wherein the means opposing the displacement of the pin from the predetermined initial position comprise a spring.

30. A tool according to claim 29, wherein the pin is biased to its initial position by the spring.

31. A tool according to claim 30, wherein the spring has an adjustable initial stress.

32. A tool according to claim 22, wherein the means opposing the displacement of the pin from the predetermined initial position comprise a piston which is biased by compressed air.

33. A tool according to claim 32, wherein the pin is biased to its initial position.

34. A tool according to claim 23, wherein the housing has a cylindrical internal bore, which is centered on the longitudinal center line of the cartridge case, the sensing means comprise a rod, which is axially slidably mounted in said internal bore and at one end is provided with a pin, which carries a spring abutment, and a compression spring is disposed in the housing and at one end bears on said spring abutment and at the other end bears on the housing.

35. A tool according to claim 23, wherein a compressed air chamber is contained in the housing and a piston that is biased by compressed air is slidably mounted in said compressed air chamber and is secured to a rod, which is axially slidably mounted in the housing and at one end carries the pin.

36. A tool according to claim 23, wherein the initial position of the pin is adjustable.

37. A tool according to claim 23, wherein the indicating means comprises a visual indicator.

38. A tool according to claim 37, wherein a rod which carries the pin is disposed in the housing, said housing has an end wall which is formed with a hole and that end of the rod which is remote from the pin protrudes into said hole and together with said end wall constitutes the visual indicator.

39. A tool according to claim 23, wherein the indicating means comprises an electric switch, which is arranged to be actuated in response to a predetermined displacement of the pin.

40. A tool according to claim 39, wherein the indicating means is electrically connected to an alarm signal generator.

41. A tool according to claim 39, wherein the indicating means is electrically connected to switching means.

42. A device for distinguising between two different fuzing systems of cartridge cases for center fire cartridges, each cartridge case comprising a base at one end and defining an open mouth at an opposite end and a longitudinal center line, the fuzing system of each cartridge case being held in the base and one of the fuzing systems including a central vent coaxial with the center line in the base, which comprises (a) an optical sensor for sensing the central vent and being movable into the cartridge case through the cartridge case mouth along the longitudinal center line, the optical sensor generating a signal upon sensing the central vent, and (b) an indicator means arranged to receive the signal from the optical sensor for indicating the fuzing system of the cartridge case.

43. A device according to claim 39, wherein the optical sensor comprises an optical glass fiber cable.

* * * * *